United States Patent [19]

Beiley et al.

[11] Patent Number: 4,793,167

[45] Date of Patent: Dec. 27, 1988

[54] ROLLER SWAGING MACHINE

[76] Inventors: Mark J. Beiley, 26114 Belle Porte, #11, Harbor City, Calif. 90710; Makram T. Mikhail, 10667 Freer St., Temple City, Calif. 91780

[21] Appl. No.: 57,325

[22] Filed: Jun. 2, 1987

[51] Int. Cl.[4] ..... B21D 39/10

[52] U.S. Cl. ..... 72/19; 72/30; 72/122

[58] Field of Search ..... 72/19, 122, 123, 125; 29/727

[56] References Cited

U.S. PATENT DOCUMENTS

| | | | |
|---|---|---|---|
| 1,514,712 | 11/1924 | Maupin | 72/122 |
| 3,031,008 | 4/1962 | Schmidt . | |
| 3,585,701 | 6/1971 | Stary . | |
| 3,628,227 | 12/1971 | Blackburn et al. . | |
| 4,066,942 | 1/1978 | Bardwell et al. . | |
| 4,147,385 | 4/1979 | Velden . | |
| 4,215,594 | 8/1980 | Workman, Jr. et al. . | |
| 4,239,713 | 12/1980 | Brif et al. . | |
| 4,658,616 | 4/1987 | Bastone . | |

FOREIGN PATENT DOCUMENTS 2506326 8/1976 Fed. Rep. of Germany .

OTHER PUBLICATIONS

Handbook for the Type 2,000 MK 2A Swaging Machine (Dated 11-81), Lancashire, England-pp. 1, 2, 5, 8, 15, 18 and 19.

Boeing Document No. D-48861-pp. 1, 4, 5, 7, 8, 9, 11-21 Dec. 1981.

*Primary Examiner*—Lowell A. Larson

*Attorney, Agent, or Firm*—Sheldon & Mak

[57] ABSTRACT

A machine and method for roller swaging hydraulic fitting sleeves onto metallic tubing comprises a tapered roller mandrel expander driven at a first high speed for rapidly expanding the tubing and at a second low speed until the drive torque reaches a final preselected value for preventing springback of the tubing and accurately controlling the amount of swaging. Both torque control of swaging and diameter control of swaging can be effected. A torque transducer monitors mandrel loading for automatic control of machine operations. A mechanical stop for interaction with the mandrel support regulates advance of the mandrel and thereby relates to diameter control. The diameter control is effected by torque measurements which are responsive to diameter positions. Low speed burnishing can be effected during diameter control at the end of the cycle. The machine provides an automatic swaging cycle with an optimum overall time cycle for swaging performance.

38 Claims, 7 Drawing Sheets

EX
P
AUX

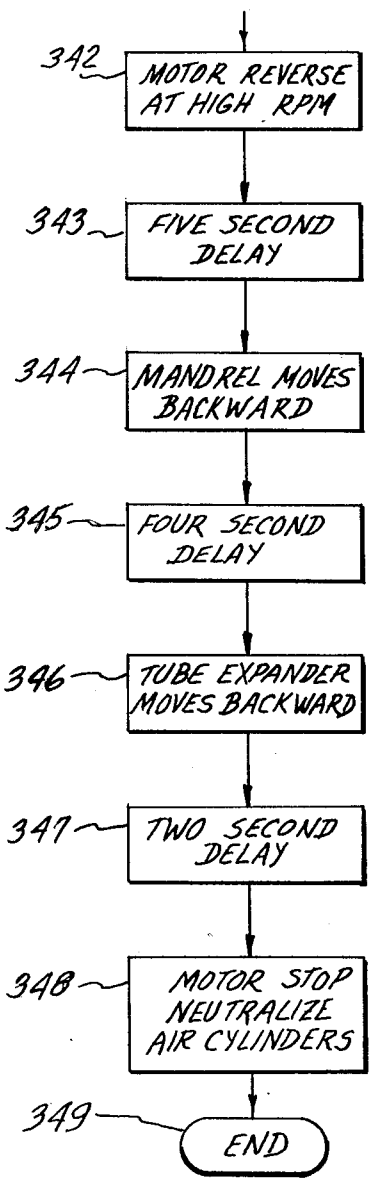
FIG. 7B
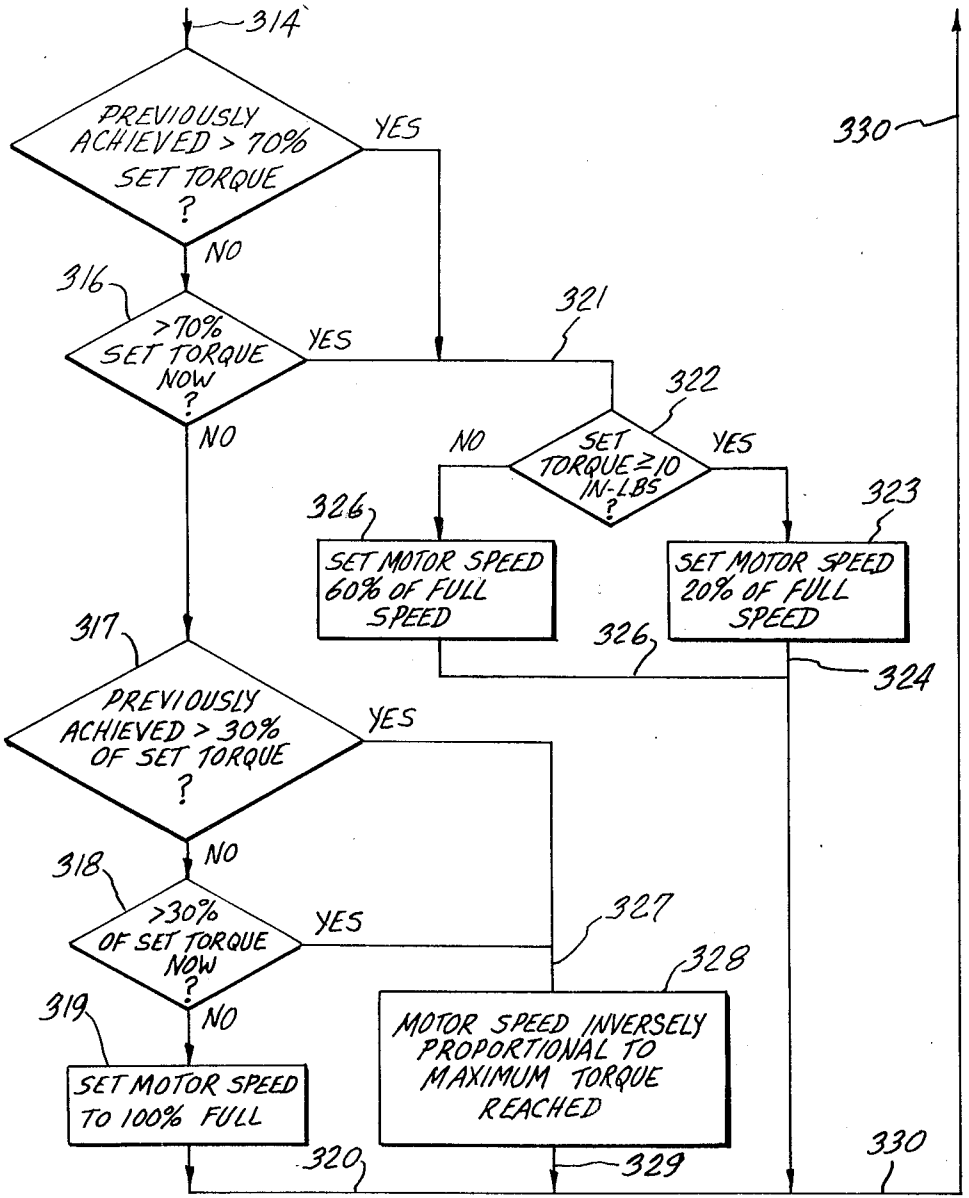

ROLLER SWAGING MACHINE

BACKGROUND

This invention relates to roller swaging of tubing, such as for attaching hydraulic fitting sleeves to high strength, thin wall, aerospace hydraulic tubing. Such swaging machines are disclosed in U.S. Pat. No. 4,658,616 (Bastone) assigned to the assignee of this application. The contents of that patent are incorporated by reference herein.

Roller swaging of tubing for attachment of hydraulic fittings is a common practice in the aerospace industry. In roller swaging, the end of an expander assembly is inserted into the tube to be swaged. At the time of insertion, a sleeve to be swaged onto the tube is loosely in place on the tube. The end of the expander assembly includes a plurality of rollers that are free to move radially toward and away from the longitudinal axis of the expander assembly. A rotating tapered mandrel is moved along the axis of the expander assembly, frictionally engaging the rollers and forcing the rollers against the inner wall of the tube. The mandrel continues to rotate and advance, causing the rollers to expand the tube, forcing tube material to flow into grooves in the sleeve, effecting a strong sealed connection between the tube and the sleeve.

Prior art roller swaging have exhibited some disadvantages. These include poor control being either insufficient or too much swaging. Either condition can result in leakage, which is a particular problem with titanium tubing.

There is also low speed operation. Manual adjustments and operations are time consuming and therefore expensive. When titanium tubing is used, a slow rate of swaging is required to prevent the tubing from springing back to a smaller diameter following completion of the swage, which can result in failure of the joint. With the slow rate, however, the cycle time can be too long for efficient operation of the swaging machine.

Generally, roller swaging in the prior art employs either a torque control of the swaging tool whereby the torque measures the amount of swage. Alternatively, a diameter control is used wherein the inside diameter measurement of the swaged tube is used to indicate the degree of swage. This diameter measurement control is effected mechanically and is prone to error due to error in the mechanical settings.

In the method of diameter control it has been found that when swages are made to a selected inner tube diameter, the strength of the swaged connection is not as consistent as desired. This lack of consistency is due to variations in tube wall thickness and diameter, and to a lesser extent, sleeve wall thickness and diameter. Moreover, it is relatively difficult to effect accurately the correct diameter settings. Diameter control is however advantageous in that the expander units are less costly since they do not have to be calibrated and certified to swage at a specific torque range as do expanders working in the torque control mode.

Roller swaging under torque control exhibit one or more of the following disadvantages:

1. Individual, interchangeable, pre-set torque limiters are awkward to exchange and store, and impractical to adjust;

2. Torque sensing by measurement of electrical current in a mandrel drive motor can be inaccurate;

3. Torque limiting based on balancing a gimballed motor housing against an adjustable bias such as a spring requires time-consuming manual adjustment of the bias to effect a change in the limiting torque;

4. Torque limiting by manual use of a torque wrench driving the mandrel is too slow for economical production and subject to operator-induced variation; and 5. Non-uniform swaging results from failure to compensate for the torque required to turn the mandrel before swaging actually begins.

A torque-controlled swaging machine of U.S. Pat. No. 4,658,616 (Bastone) discloses a technique for high speed-low speed swaging under control of a torque transducer which monitors torque. This apparatus however does not optimise the swaging effect and also does not take into account the positive effects of diameter control of swaging. Moreover, with larger diameter tubing and a low-speed which is relatively high, namely, about 50% of the high speed, the final torque is relatively difficult to control. Accordingly, the final swage level also proves difficult to maintain accurately.

It is also generally desirable to finish a swaged joint with a burnishing effect. This is not effected with the torque control machines of the prior art. Mechanical diameter control swaging machines have used burnishing, however, the disadvantage of that procedure is that the tool life is shortened due to the interaction of the swaging rollers on the mandrel which the swaging forces are extensive and the speed of rotation is high.

Thus there is a need for a roller swaging machine which can have the benefits of both torque control and diameter control, burnishing, close control of the amount of swaging, has long tool life, swages at an overall high cycle speed, is easy to use, and is automatic in operation.

SUMMARY

Accordingly the swaging machine of the present invention employs the benefits of both torque control, diameter control, burnishing, close control of the amount of swaging, has long tool life, swages at overall high cycle speed in an automatic swaging cycle, and is easy to use. With the invented machine swaging is finished at a speed sufficiently low that accurate control of the amount of swage is achieved.

The invented swaging machine is operable in either a torque mode or a diameter control mode. In the latter mode, diameter control is effected by a torque measurement which is proportional to the diameter sizing and a mechanical stop. Also in the diameter control mode, burnishing is effected after the prerequisite diameter is reached, the speed has been reduced, and the torque on the swaging tool rollers is reducing.

The machine includes a roller expander having a tapered mandrel which is rotated and advanced to expand the tube into engagement with a fitting sleeve, and a motor drive rotating the mandrel at high speed and low speeds, and means controlling the drive for rotating the mandrel at the high speed during initial expansion of the tube and at low speed of about 20 percent of the high speed during final expansion of the tube when rotation of the mandrel requires more than 70 percent of a final maximum torque. The high and low speed rotation of the mandrel provides the advantages of rapid swaging and an absence of spring back following the conclusion of the swaging operation. The 20 percent speed level is particularly important for swaging titanium tubing so as to avoid springback and yet to obtain an effective overall operating cycle of less than 1 minute per swage, and preferably about 45 seconds.

In the diameter control mode, the torque measurement is preset relative to the tube diameter, and the maximum expansion diameter is preset relative to the tube diameter. After the preset diameter is reached, the torque on the swaging tool reduces and tube burnishing is effected for a predetermined number of revolutions of the swaging tool. Burnishing is particularly desirable since it permits for more accurate swage inspection to determine swage quality and effect.

In the torque control mode, when the measured torque reaches a predetermined final value, rotation of the mandrel is reversed, ending the swaging operation.

Preferably the drive has torque transducer for measuring the torque required to rotate the mandrel during swaging. The torque transducer, taking the place of awkward individual torque limiters, time-consuming manual-operations and adjustments, and inaccurate sensing of motor current levels, continuously provides for monitoring of mandrel torque while swaging a variety of tube and sleeve combinations. The measurements by the torque transducer can be compared with one or more references corresponding to each of the tube and sleeve combinations.

Preferably the torque transducer is provided with zeroing means compensating for the torque required to turn the mandrel before the initial expansion of the tube. The compensation of the torque transducer is preferably repeated at the beginning of each swaging cycle to provide a precisely uniform amount of swaging for improved uniformity in the swaged connections. An additional advantage is that a more uniformly high proportion of swaging can be done at high speed without spring back.

For the diameter control operation, there is provided a mechanical stop device, axially adjustably movable on the mandrel body, such that axial advance of the mandrel is stopped by interaction of the mechanical stop with an interacting element of the mandrel.

The high speed drive of the mandrel can be terminated, commencing the low speed drive, after a predetermined advance of the mandrel with corresponding expansion of the tube. Preferably the high speed drive is terminated after a predetermined intermediate drive torque level is reached, a torque level of about 20 to 30 percent of that required to complete the swage for avoiding a need to measure the advance of the mandrel. Preferably the intermediate drive torque level is at least approximately 30 percent of that required to complete the swage.

In some preferred form of the invention, the speed reduction is in the range of 10% to 30% of high speed. When the final speed is at the lower level, the onset of the ramp will be at the lower end of the torque range, namely 20%. When at the higher end of the speed range, namely, 30%, the torque will be about 30% of the final torque. In the diameter control mode at about 100% of preset torque, the mandrel advance is effectively controlled or checked by the mechanical stop interaction which had been pre-established.

Preferably, the machine is provided with an automatic swaging cycle initiated by the operator following clamping of the die, the machine automatically;

(a) inserting the expander;

(b) rapidly rotating and advancing the mandrel until the rollers engage the tube; and (c) continuing the rapid rotation until a predetermined first torque level is reached.

In the torque control mode, the speed is ramped downwardly to about 20 percent of the speed of rapid rotation until a predetermined final torque level is reached. Ramping is effected through pulse width modulation speed control, and commenced at a time earlier in the operative cycle than prior art methods, namely, when the torque is about 20% of final torque. This is consistent with providing an overall short time operational cycle for swaging.

In the diameter control mode, the speed is similarly ramped downwardly to about 20% of the speed of high speed rotation, while the torque increases. Contact with a mechanical stop device for limiting mandrel advance and roller expansion thereafter causes the torque to drop. Sensing of the drop activates a system for permitting a predetermined number of burnishing revolutions at about 20% of full speed.

Under both torque and diameter control after the 20% speed cycle there follows reverse rotation of the mandrel for releasing the expander, and retraction of the mandrel and the expander.

Thus an automatic roller swaging machine is provided which is torque controlled or diameter controlled, permits for effective burnishing, closely controls the amount of swaging, has long tool life, swages at high speed, with a short term operational cycle, and is easy to use.

DRAWINGS

These and other features, aspects, and advantages of the present invention will become better understood with reference to the following description, appended claims, and accompanying drawings where:

Figure 6:
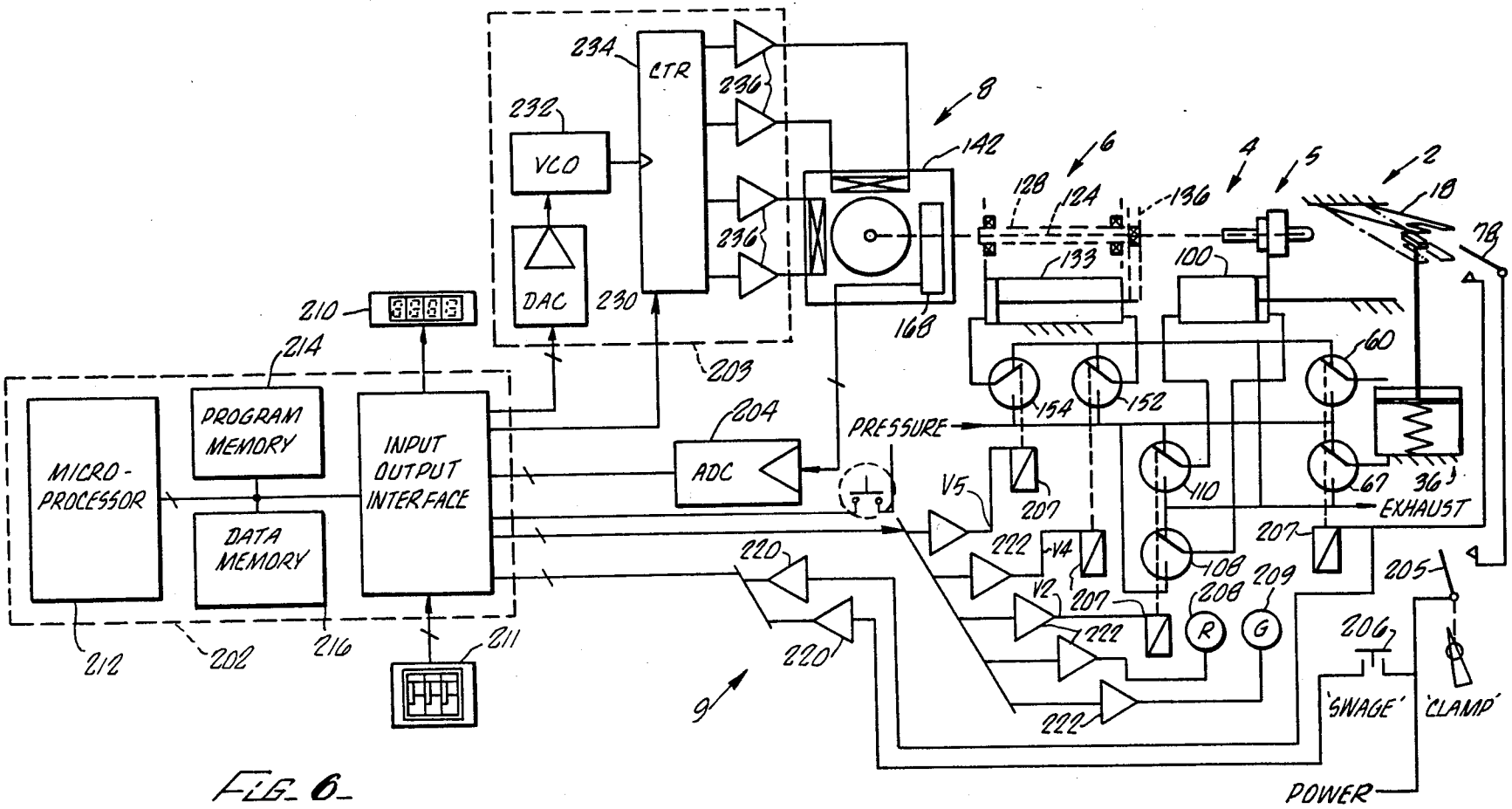
FIG. 6 is a block diagram of the machine of FIG. 1, including a computer system for automatically controlling a swaging cycle.
Figures 7, 7A, 7B:
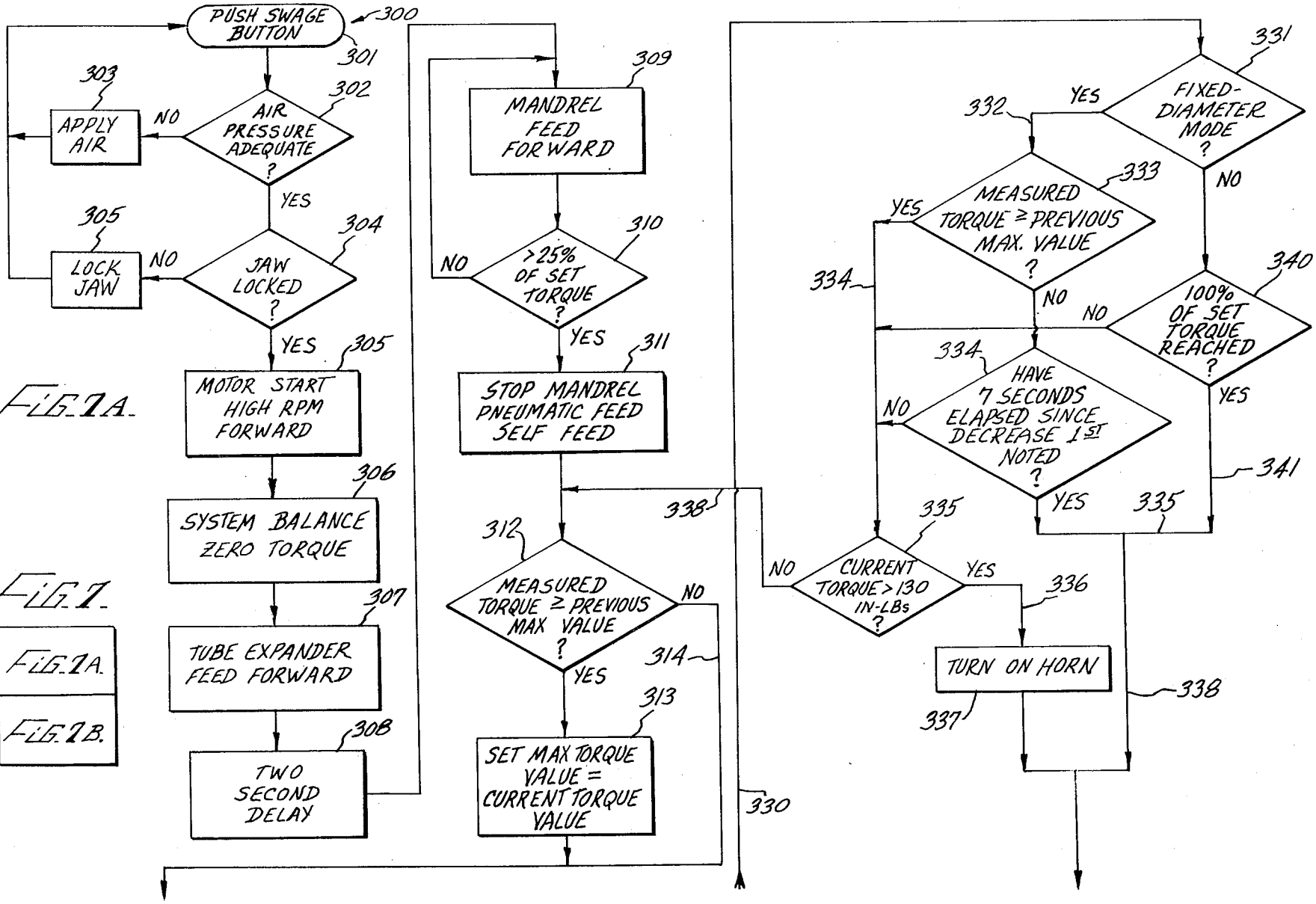
Figure 8:
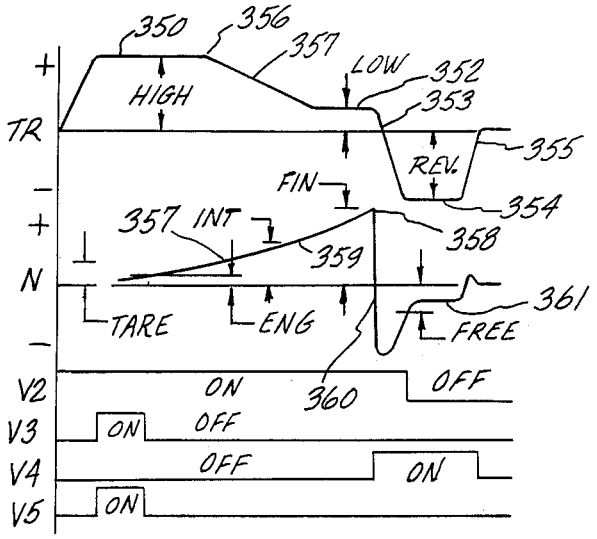
Figure 9:
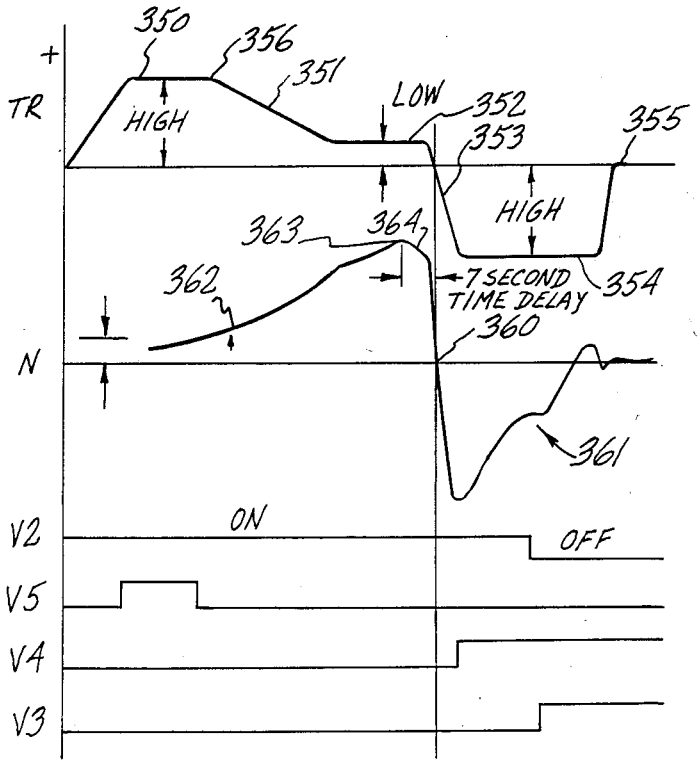

FIG. 7, *7a* and *7b* is a flow chart for a computer program controlling the computer system of FIG. 6; and FIG. 8 is a timing diagram of the swaging cycle provided by the computer system of FIG. 6, according to the computer program of FIG. 7 for the operation in a torque control swaging mode FIG. 9 is a timing diagram of the swaging cycle provided by the computer systems of FIG. 6, according to the computer program of FIG. 7, for the operation in a diameter control swaging mode.

DESCRIPTION

An automatic roller swaging apparatus and method for attaching hydraulic fittings to metallic tubing effects swaging at high speed until nearly complete, then at low speed to prevent harmful springback of high strength tubing material such as titanium.

The machine can operate in either a torque control mode or a diameter control mode to effect swaging. In both cases, the low speed is about 20 percent of the high speed, and the speed reduction begins at a relatively early stage in the swaging process. Speed reduction is ramped downwardly at about 20% to 30% of final torque. In the diameter control mode, burnishing is effected at slow speed and with reduced torque. The overall time cycle of the swaging operation is optimum at less than 1 minute per swage to provide effective swaging results.

A machine for swaging according to the present invention comprises a vise unit 2 for clamping workpiece elements, a tool unit 4 movably mounted thereon for axially positioning an expander tool 5, a spline unit 6 rotationally coupling and axially engaging the expander tool 5, a motor unit 8 for rotationally driving the spline unit 6. The machine is connected in a computer system 9 for automatic control of a swaging cycle.

Vise Unit 2

With reference to FIGS. 1–5, a tube 10, with a sleeve 11 in place thereon, are the workpiece elements clamped in the vise unit 2. The vise unit 2 is mounted on a base 14, which is supported at a convenient height by a suitable frame, not shown.

The vise unit 2 includes a stationary jaw 16, attached to the base 14 by a plurality o screws 17. A movable jaw 18 is pivotably attached to the stationary jaw 16 by a hinge pin 20, the hinge pin 20 being parallel to and laterally displaced from the tube 10. The hinge pin 20 is held in place by a retaining ring 21 on each end thereof. The stationary jaw 16 and the movable jaw 18 are each adapted to receive interchangeable sets of dies for clamping various sizes of the tube 10 and the sleeve 11. Each set of ties includes a pie ring 22, a lower die shell 24, and an upper die shell 26. The lower die shell 24 is clamped within the stationary jaw 16 by means of a pair of die screws 28. The upper die shell 26 is retained in the movable jaw 18 by a pair of oppositely disposed die spring plungers 30. The die ring 22 is provided with a cavity 32, closely fitting one end of the sleeve 11. The cavity 32 includes a shoulder 33 to facilitate positioning the tube 10 flush with the sleeve 11.

The die ring 22 and that portion of the sleeve 11 not within the cavity 32 are rigidly clamped by closely fitting portions of the lower die shell 24 and the upper die shell 26. The die ring 22, the lower die shell 24, and the upper die shell 26 combine to prevent expansion of the sleeve 11 during swaging of the tube 10. The die ring 22, confining a critical portion of the sleeve 11 within the cavity 32, has no parting line within the critical region so that no pressure ridges are produced on the sleeve 11 in that region during swaging. Such pressure ridges would otherwise impair proper sealing of the sleeve 11 to a fitting in use. Pressure ridges developed during swaging at parting lines between the die ring 22, the lower die shell 24, and the upper die shell 26 are not detrimental to proper functioning of the sleeve 11.

A pair of resilient ring members 34, surrounding the tube 10, are retained by the lower die shell 24 and the upper die shell 26. The ring members 34 resiliently clamp the tube 10 so that once positioned against the shoulder 34 of the die ring 22, the tube 10 is held in position prior to, and prevented from rotating during swaging.

The movable jaw 18 is held tightly closed against the stationary jaw 16 during swaging by a clamp actuator 36. The clamp actuator 36 includes a clamp shaft 38 which is slidably and rotatably located perpendicular to the hinge pin 20 and displaced oppositely from the tube 10 with respect to the hinge pin 20. The clamp shaft 38 has a dog 40 for engaging a dog seat 42 in the movable jaw 18. The clamp shaft 38 passes through a dog slot 44 in the movable jaw so that the dog 40 can be selectively engaged and disengaged from the dog seat 42 by rotation of the clamp shaft 38.

A pair of slot cams 46 are provided on opposite sides of the clamp shaft 38, each slot cam 46 engaging a corresponding cam pin 48 resiliently mounted in the stationary jaw 16. Each cam pin 48 can be a commercially available threaded spring-plunger.

Each of the slot cams 46 is configured to rotate the clamp shaft 38 from an engaged position when the dog is holding the movable jaw 18 against the stationary jaw 16, and, when the clamp shaft 38 is axially displaced to release a clamping force, rotated so that the dog 40 can pass through the dog slot 44. The rotation of the clamp shaft 38 thus permits the movable jaw 18 to be opened completely clear of the clamp shaft 38, facilitating loading and unloading of the tube 10 and the sleeve 11, and exchanging die sets.

Axial movement of the clamp shaft 38 is accomplished by a clamp piston 50 operating in a clamp cylinder 52, the clamp cylinder 52 being sealingly clamped between a clamp cylinder block 54 and a clamp cylinder head 56 by a plurality of clamp cylinder screws 58. The clamp cylinder screws 58 can be threaded into the base 14 for securing the clamp cylinder block to the underside of the base 14. A first solenoid valve 60 is hydraulically connected through the clamp cylinder block 54 for selectively pressurizing and exhausting a volume within the clamp cylinder 52 above the clamp piston 50. A shoulder ring 62 is fixed to the bottom of the clamp shaft 38 for axial operation of the clamp shaft 38. A compression spring 64, located between the shoulder ring 62 and the clamp cylinder head 56, biases the clamp shaft 38 upwardly against hydraulic pressure above the clamp piston 50. A pair of thrust bearings 66 is provided in the clamp actuator 36 to facilitate free rotation of the clamp shaft 38 corresponding to axial movement of the clamp shaft 38. The thrust washers 66 are located between the compression spring 64 and the clamp cylinder head 66, and between the clamp piston 50 and the shoulder ring 62.

The compression spring 64 lifts the clamp shaft 38 when the first solenoid value 60 is deenergised or when hydraulic pressure is not available. This insures that the view unit 2 may be opened when power is removed from the machine.

Preferably an auxiliary solenoid valve 67 is hydraulically connected through the clamp cylinder head 56 for selectively pressuring and exhausting a volume within the clamp cylinder 52 below the clamp piston 50.

When the first solenoid valve 60 is unenergized (and the auxiliary solenoid valve 67 is energized), hydraulic pressure above the clamp piston 50 is exhausted, permitting the compression spring 64 and hydraulic pressure below the clamp piston 50) to lift the clamp shaft 38, lifting the dog 40 from the dog seat 42 and rotating the dog 40 into alignment with the dog slot 44. The hydraulic pressure below the clamp piston 50 causes the clamp shaft 38 to be lifted more rapidly than if it were raised by the compression spring 64 alone. A jaw handle 68, attached to the movable jaw 18, can then be used to open the movable jaw 18 clear of the dog 40. A slot cover 70, attached to the movable jaw 18 by cover screws 71, shields the fingers of an operator from inadvertent contact with the dog 40. The movable jaw 18 is provided with a jaw detent 72, engaging a detent spring plunger 74 for holding the movable jaw 18 in an open position. The movable jaw 18 can also be provided with a thumb screw 76 for assisting in removing the upper die shell 26 when use of a different die set is desired.

When the tube 10 the sleeve 11 and the die ring are in place in the lower die shell 24 the operator closes the moveable jaw 18 while holding the tube 10 against the shoulder 33 of the cavity 32. The first solenoid valve 60 may then be energized (the auxiliary solenoid value 67 unenergized), lowering the clamp piston 50 and the clamp shaft 38, rotating and lowering the dog 40 into engagement with the dog seat 42, clamping the tube 10 and the sleeve 11 between the lower die shell 24 and the upper die shell 26.

Preferably an interlock switch 78 fastened to the stationary jaw 16 by a pair of switch screws 79 is actuated when the movable jaw 18 is closed against the stationary jaw 16. The interlock switch 78 can be electronically connected to prevent the first solenoid valve 60 from becoming energized unless the movable jaw 18 is closed.

Tool Unit 4

The tool unit 4 is slidably located on a pair of guide rods 82, the guide rods 82 being fixably mounted to the stationary jaw 16 of the vise unit 2. The guide rods 82 are parallel with the tube 10 and axially located with respect to the stationary jaw 16 by a pair of retainer rings 84. The tool unit 4 includes a tool block 86 guided by the guide rods 82 and having a removable tool cap 88, the tool block 86 and the tool cap 88 enclosing and locating the expander tool 5, described below, in axial alignment with the tube 10.

A pair of guide bearings 92, installed on opposite sides of the tool block 86, locates the tool block 86 on each of the guide rods 82. The tool cap 88 is provided with a pair of dowel pins 94, fixably mounted thereto, for slidably engaging the tool block 86 to locate the tool cap 88 on the tool block 86, for convenient removal of the tool cap 88 from the tool unit 4. A dowel spring plunger 96 can be mounted in the tool block 86, engaging the dowel pin 94, for holding tool cap 88 against the tool block 86 to prevent misalignment of the expander tool 5.

A tool piston 98 is fixedly attached to each die rod 82 for hydraulic actuation of the tool unit 4, axially positioning the expander tool 5 with respect to the tube 10. Each tool piston 98 slidably engages a tool cylinder 100, each tool cylinder 100 being sealingly clamped between a respective tool cylinder head 102 and a tool cylinder block 104 by a plurality of tool cylinder screws 106. The tool cylinder screws 106 can be threaded into the tool block 86 for fixing each tool cylinder block 104 against the tool block 86. A second solenoid valve 108 is hydraulically connected to the tool cylinder block 104 for selectively pressurizing and exhausting the tool cylinder 100 between the tool piston 98 and the tool cylinder block 104. When hydraulic pressure is applied by the second solenoid valve 108, the tool unit 4 is caused to move toward the vise unit 2, advancing the expander tool 5 into the tube 10.

A third solenoid valve 110 is hydraulically connected to the tool cylinder heat 102 for selectively pressurizing and exhausting the tool cylinder 100 between the tool cylinder head 102 and the tool piston 98. When hydraulic pressure is applied by means of the third solenoid valve 110, the tool unit 4 is caused to move away from the vise unit 2, withdrawing the expander tool 5 from the tube 10.

The second solenoid valve 108 can be operated in conjunction with the third solenoid valve 110 as a four-way solenoid valve, as described in more detail below. Similarly, the first solenoid valve 60 can be operated in conjunction with the auxiliary solenoid valve 67 as another four-way solenoid valve. Thus, operation of the first solenoid valve 60 and the second solenoid valve 108 impliedly include opposite operation of the auxiliary solenoid valve 67 and the third solenoid valve 110, respectively.

Expander Tool 5

The expander tool 5 includes a cylindrical expander body 112, having a nose portion 114 is rotatably mounted in a journal housing 116, the nose portion 114 having an outside diameter slightly smaller than the inside diameter of the tube 10. The journal housing 116 is adapted to be retained between the tool block 86 and the tool cap 88, and removable for easily exchanging the expander tool 5. A plurality of tapered rollers 118 is retained by the nose portion 114, the tapered rollers 118 being free to travel outwardly beyond the circumference of the nose portion 114. A tapered mandrel 120, centered within the expander body 112, engages the tapered rollers 118, forcing the tapered rollers 118 outwardly in response to axial movement of the tapered mandrel 120. The tapered rollers 118 and the tapered mandrel 120 have complimentary tapers, the tapered rollers 118 inscribing a cylindrical surface when engaged with the tapered mandrel 120. The tapered rollers 118 are aligned by the nose portion 114 in a slightly skewed configuration with respect to the nose portion 114, so that rotation of the tapered mandrel 120, while engaging the tapered rollers 118 against the inside diameter of the tube 10, results in axial advancement of the tapered mandrel 120 and progressive enlargement of the tube 10 by the tapered rollers 118. Conversely, opposite rotation of the tapered mandrel 120 releases the tapered mandrel 120 from the tapered rollers 118, facilitating withdrawal of the expander tool 5 from the tube 10 following completion of a swaging operation.

Preferably the tapered mandrel 120 has, opposite to the journal housing 116, a square drive member 121 for external drive. Preferably the drive member 121 is equipped with a spring-loaded coupling pin 122, for facilitating exchange of the expander tool 5.

A mechanical stop 400 is mounted on a cylindrical body portion 401 between the square drive member 121 and the tapered mandrel 120. The stop 400 limits the axial movement of the cylindrical body 401 an hence the mandrel 120 forwardly by abutment between face 402 and 403 of cylindrical sleeve 404. In this manner, the degree of expansion of the rollers 118 is controlled by the limited movement of the mandrel in the nose position 114. The mechanical stop 400 is formed by two half collars 405 and 406 held together with screws 407 passing through bores 408 at opposite sides of the collar. By loosening and tightening the screws 407, the mechanical stop 400 can be adjusted axially along the cylindrical body 401. In this manner, the axial abutment of faces 402 and 403 provides a for diameter expansion.

In other embodiments, the mechanical stop 400 is mounted on the cylinder body 40 internally of the expander body 112.

Spline Unit 6

The tapered mandrel 120 is both rotated and positioned axially by a spline unit 6. A spline shaft 124 is fixedly connected to the drive member 121 of the tapered mandrel 120 by a drive coupling 126, the drive coupling engaging the coupling pin 122. The spline shaft 124 slidably engages a spindle shaft 128, the spindle shaft 128 being rotatably mounted on a pair of spindle bearings 129 in a spindle housing 100 in axial alignment with the tube 10. The spindle shaft 128 and the spindle bearings 129 are located within the spindle housing 130 by a pair of spindle retainers 131.

Two spindle pistons 132, guided within corresponding spindle cylinders 133 on opposite sides of the spindle shaft 128, are connected to provide axial movement of the spline shaft 124 within the spindle shaft 128, as further described herein.

Each spindle piston 132 is affixed at one end of a corresponding spindle rod 134 by a spindle screw 135, the opposite end of each spindle rod being fastened to a spline yoke 136 by a corresponding yoke screw 137. The spline shaft 124 protrudes through the saline yoke 136 and is rotationally coupled thereto by a yoke bearing 138. The yoke bearing 138 is held within the spindle yoke 136 by a yoke retainer 139. The yoke bearing 138 is held in place on the spindle shaft 124 by a bearing spacer 140 and a bearing retainer 141. Thus axial movement of the spindle pistons 132 in the spindle cylinder 134 produces a corresponding movement of the spline shaft 124.

The spindle cylinders 133 are each sealed at the ends thereof for the application of hydraulic pressure to opposite sides of the spindle pistons 132. A rod flange 142, sealingly engaging a corresponding spindle rod 134, is fastened to the spindle housing 130 by flange screws 143. A cylinder flange 144, fastened by additional flange screws 143, sealingly covers the opposite ends of the spindle cylinders 133. Axial movement of the spindle pistons 132 within the spindle cylinders 133 produces a corresponding axial movement of the tapered mandrel 120.

A fourth solenoid valve 152 is hydraulically connected to the spindle housing 130 for selectively pressurizing and exhausting the spindle cylinders 133 between the spindle pistons 132 and the rod flange 142. Hydraulic pressure introduced by operation of the fourth solenoid valve 152 biases the spindle pistons 132 in a direction tending to withdraw the tapered mandrel 120 from engagement with the tapered rollers 118. A fifth solenoid valve 154 is hydraulically connected to the spindle 130 for selecting pressurizing and exhausting the spindle cylinders 133 between the spindle pistons 132 and cylinder flange 144. Thus hydraulic pressure from the fifth solenoid valve 154 biases the spindle pistons 132 in a direction tending to advance the tapered mandrel 120 into engagement with the tapered rollers 118 for initiating the swaging of the tube 10.

The spindle shaft 12B is provided with a spindle extension 146 opposite the drive coupling 126 for coupling to the motor unit 8. The spindle extension 146 can be fastened to the spindle shaft 128 by a set screw 147.

Motor Unit 8

A motor unit 8 is connected to the spline unit 122 for rotation of the tapered mandrel 120. The motor unit 8 includes a motor 158 attached to a motor mount 160 in axial alignment with the tube 10. The motor mount 160 is fastened to the base 14 by the mount screws 17. The lower die shell 24, the spindle housing 130, and the motor mount 160 are each adapted to engage an alignment bar 162 fixedly attached to the base 14 by a plurality of bar screws 163 for facilitating the axial alignment of the tube 10, the spline unit 6, and the motor unit 8. The motor 158 has an output shaft 164 connected to the spindle extension 146 of the spindle shaft 128 by a spindle coupling 166. Additional setscrews 147, or coupling pins 122 can secure the spindle coupling 166 to the output shaft 164 and/or the spindle extension 146. Thus rotation of the output shaft 164 of the motor 158 produces corresponding rotation of the spindle shaft 128, the spline shaft 124, and the tapered mandrel 120.

Preferably the motor 158 is capable of variable speed drive under external control for controlling the speed of swaging, and reversible for withdrawing the tapered mandrel once swaging is complete. Thus the tapered mandrel 120 can be driven by the motor 158 at a first high speed producing rapid initial swaging for high production efficiency, followed by a second low speed producing slow final swaging for preventing springback of the tube 10 following completion of the swage. The second slow speed provides a further advantage in that swaging can be more uniformly terminated when high speeds of rotation are not involved.

Preferably the motor 158 has a plurality of windings for producing a rotating magnetic field when driven by corresponding phases of a variable frequency oscillator, for convenient operation of the motor at a speed proportional to the oscillator frequency.

Preferably the motor 156 is equipped with a torque transducer 168 for measuring the torque required to turn the mandrel during swaging for controlling the amount of swaging. The torque transducer 168 can employ a strain gage applied to the output shaft 164 and externally connected by means of slip-rings and corresponding brushes. The torque transducer is operable for both the swage measuring modes, namely, under torque control mode and also diameter control mode.

Preferably the motor 158 includes reduction gearing for matching motor characteristics with speed and torque drives requirements of the tapered mandrel 120. Preferably the torque transducer 168 is configured with a static element sensing reaction forces associated with the reduction gearing for permitting electrical connection to the sensing element without requiring slip-rings and brushes.

The motor speed reduction is effected by a pulse width modulated technique in the driving force. Thus, at the initial high speed, the dwell time at the higher speed is larger than the dwell time at zero speed. Progressively, the dwell time for zero speed increases while the dwell time for the higher speed decreases. The overall speed of the motor thereby decreases in an overall ramp fashion from a high speed to a low speed.

Operation

Figures 1, 5:
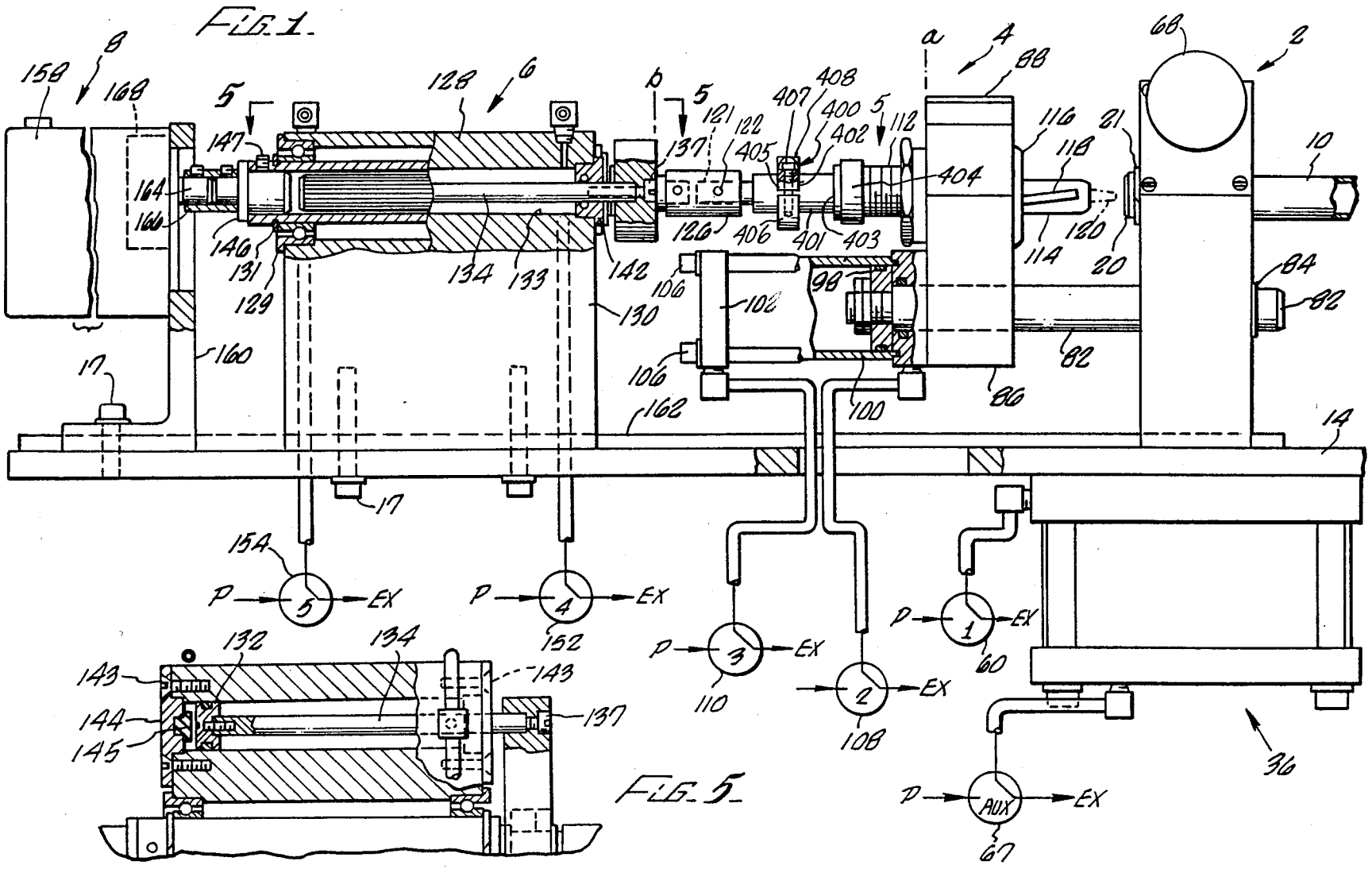
FIG. 1 is a fragmentary side elevational view of a roller swaging machine according to the present invention, the machine incorporating a roller expander assembly shown in a disengaged position; and a mechanical stop operative with the assembly.
FIG. 5 is a fragmentary sectional plan view of the machine of FIG. 1 taken along 5—5 in FIG. 1.

In operation, the tube 10 and the sleeve 11 are loaded into the vise unit 2. Pressure is applied to the clamp actuator 36 by the first solenoid valve 60, clamping the die set closed around the tube 10 and the sleeve 11 as described above. At this point an automatic swaging cycle can be initiated, the machine elements being first positioned as shown in FIG. 1. The tool unit 4 is in position a, holding the expander tool 5 in a retracted position. The spline yoke 136 is in position b, holding the tapered mandrel 120 in a withdrawn position. In the automatic swaging cycle, the motor 158 is energized, beginning forward rotation of the tapered mandrel 120. The second solenoid valve 108 is also energized, applying hydraulic pressure to the tool cylinder block 104, thereby advancing the tool unit 2 to position c in FIG. 2. The movement of the tool unit 2 from position a to position c positions the nose portion 114 of the expander tool 5 within the tube 10. At the same time, the tapered mandrel 120 is carried along with the expander tool 5, causing the spline shaft 124 to be extended from the spindle shaft 128 until the spindle yoke 136 is at position d in FIG. 2.

Preferably a tare torque measurement of the drive torque required to turn the tapered mandrel 120, prior to swaging, can be measured, once the motor 158 has reached a stable speed. This measurement, corresponding to rotational drag on the output shaft 164, the spindle shaft 128, the spline shaft 124 and the tapered mandrel 120, permits subsequent drive torque measurements to be compensated by the tare torque for changing drag conditions due to bearing wear and the like during the life of the machine for uniformly controlling the amount of swaging. Preferably a new tare torque is measured in each swaging cycle for correcting cycle-to-cycle variations in the rotational drag. Preferably the measurement of tare torque is zone with the tapered mandrel 120 rotating at the second low speed so that dynamic components of the tare torque will correspond to dynamic components of drag during final swaging. Following measurement of the tare torque, the tapered mandrel 120 can be driven at the first high speed for rapid initial swaging.

Figure 2:
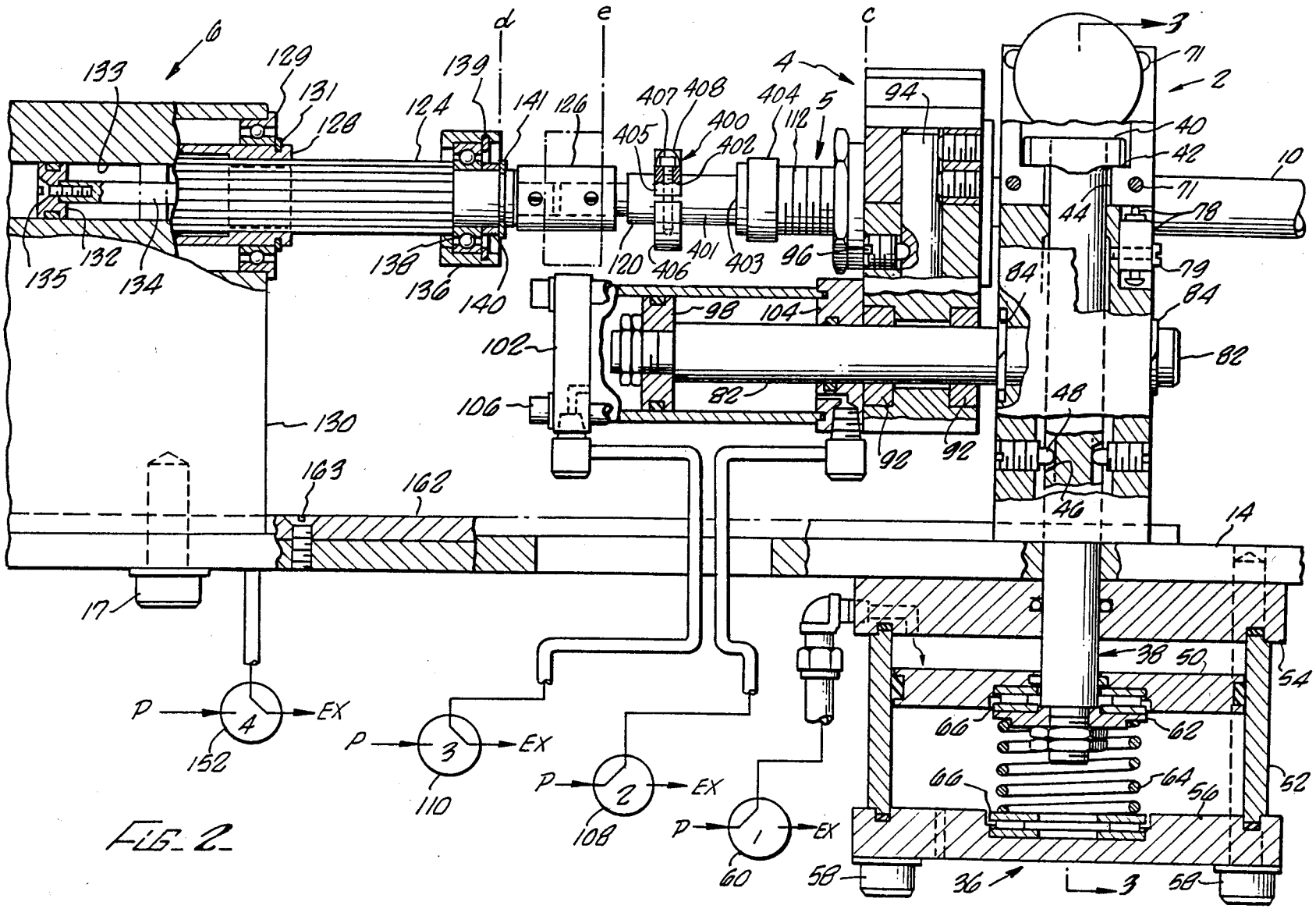
FIG. 2 is an enlarged fragmentary sectional elevational view of the machine of FIG. 1, the expander assembly and mechanical stop shown in an engaged position.
Figure 4:
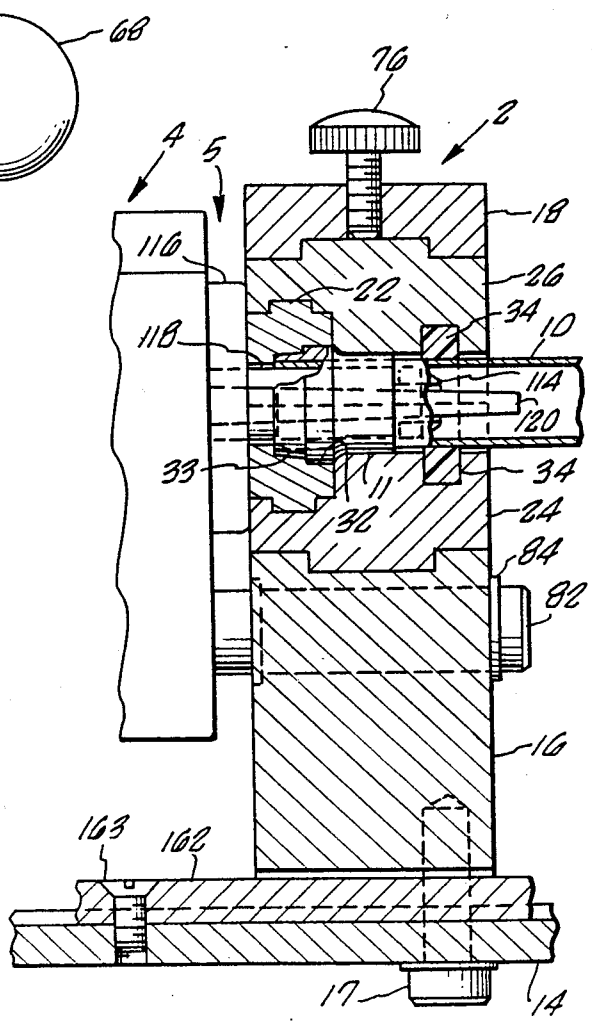
FIG. 4 is a fragmentary sectional elevational view of the machine of FIG. 1 taken along line 4—4 in FIG. 3.
Figure 3:
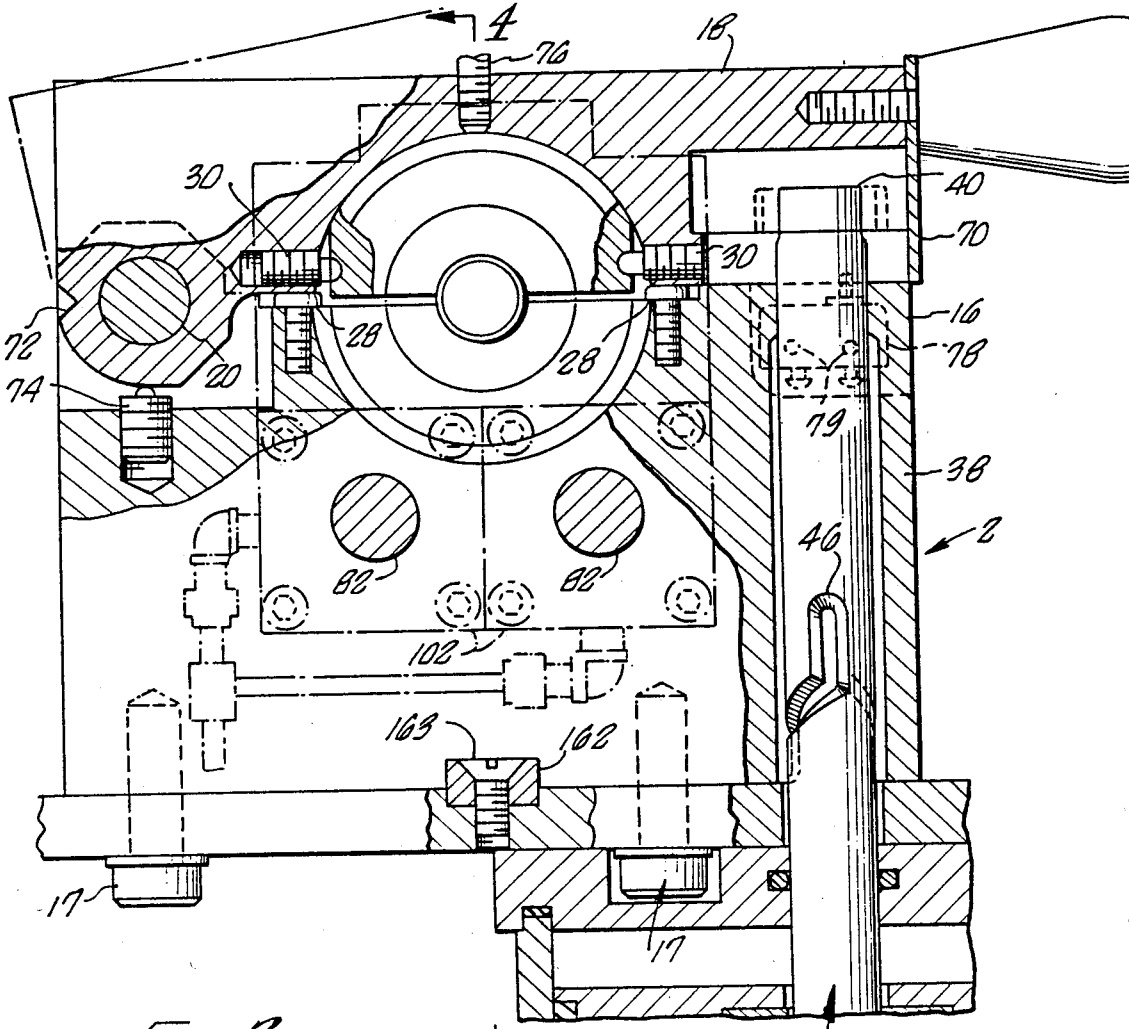
FIG. 3 is a fragmentary sectional elevational view of the machine of FIG. 1 taken along line 3—3 in FIG. 2.

Following measurement of the tare torque the fifth solenoid valve 138 is energized, directing hydraulic pressure inside the spindle cylinders 133 between the cylinder flange 14 and the spindle piston 132, moving the spline yoke 136 to position e in FIG. 2, thereby advancing the tapered mandrel 120 into engagement with the tapered rollers 118. Upon engagement of the tapered mandrel 120 with the tapered rollers 118, continued rotation of the tapered mandrel 120 by the motor 158 causes the torque sensed by the torque transducer 168 to increase to a threshold value associated with engagement of the tapered mandrel 120, and causes further advancement of the tapered mandrel 120 and corresponding enlargement of the inside diameter of the tube 10 as it is swaged by the tapered rollers 118. As the swaging of the tube 10 progresses, the torque sensed by the torque transducer 168 progressively increases toward a final value.

In the embodiment operating in the torque controlled method of swaging control the final torque value corresponds to completion of swaging at the end of the low speed cycle. When the torque sensed by the torque transducer 168 reaches a predetermined intermediate level corresponding to partial completion of swaging, the speed of the motor 158 is reduced for slowing down the rate of swaging to avoid springback of the tube 10 following completion of the swage. For example, when swaging to a final torque value of 120 in- lb., the motor 158, and the tapered mandrel 120, can be-slowed to about 20% of full speed, namely, from a first high speed of 340 RPM to 68 RPM. The first high speed continued until the drive torque reaches, about 20% to 30% of full set torque, namely, in this example, 24 to 36 in-lb.

The manner of slowing the motor 158 is by a ramp speed reduction as long as there is high speed swaging for a substantial portion of the swaging, and a subsequent significant amount of low-speed swaging at about 20% of the high speed until swaging is complete. In the above example, the speed can be reduced to 68 RPM before the torque reaches 84 in-lb., namely, 70% of the final torque value.

As the motor output shaft 164 continues to rotate at the slow speed, the torque sensed by the torque transducer 168 continues to increase. When the torque reaches a predetermined final value, swaging is halted rapidly by reversing power to the motor 158 for preventing further increased torque, and for disengaging the expander tool 5.

The intermediate torque level triggering the second slow speed is a significant proportion, at least 60% of the final value for substantially decreasing the time required for swaging below the time required to swage at the slow speed only. Preferably the intermediate torque level is about 70% of the final value for further decreasing the time required for swaging.

It should be understood that the high and low speeds of rotation of the mandrel 120 can be implemented in an alternative system including means for measuring axial advance of the tapered mandrel 120, wherein the second slow speed is triggered by a predetermined advance of the tapered mandrel 120.

In order to prevent springback of the tube 10, the mandrel should be driven at no more than half and preferably not more than about twenty percent of the first high speed while the torque is more than 70% of the final value.

As an indication of the time savings achieved with the present invention, based on a final torque value of 120 in-lb., an intermediate level of 20% of the final value, an initial engaged torque of 10% of the final value, and ramp slowing to a second slow speed of 20% of the first high speed, the torque increase can be approximated by a logarithmic time relationship inversely proportional to the swaging speed. This represents far less than the time required for the entire swage to be completed at the low speed, representing a dramatic improvement in productivity over single-speed swaging of the prior art, resulting in a substantial cost savings. Similarly, the swage operation is equivalent, from an overall time cycle perspective to the time cycle of a sudden speed drop to about 50%; however, the 20% low speed provides significant advantages in the final swaged product since the final torque is accurately controlled at the slow speed.

When the swaging is halted, the fifth solenoid valve 154 has been deenergized and the fourth solenoid valve is energized, biasing the spline yoke 136 toward position b in FIG. 1. The second solenoid valve 108 is also deenergized, biasing the tool unit 4 away from the vise unit 2. Once the tapered mandrel 120 has rotated sufficiently in the reverse direction, the tool unit 4 and the spline yoke 136 return to positions a and b respectively in FIG. 1. The first solenoid valve 60 is next released, the dog 40 lifting and rotating from engagement wit the dog seat 42 so that the upper die shell can be raised to an open position by the operator. The completed assembly of the tube 10 and the sleeve 11 can then be removed from the vise unit 2 and a new swaging cycle can be initiated.

With diameter control of swaging, the mechanical stop 400 is located in the desired axial position on the cylindrical body 401 to effect interaction between faces 402 and 403 at the prerequisite degree of roller expansion beyond the mandrel circumferarnce. Thus, the diameter control is governed by the limited axial advance of the mandrel.

The initial phases of the operation in the diameter control mode is the same as in the torque control mode. High speed operation is effected up to about 20–30% of the preset torque, and thereafter ramps downwardly until approximately 20% of full set speed during which time the torque increases to approximately full set torque. The apparatus is set so that at this 20% speed, the torque level is in a range of about 80% to 100% full torque. The torque would continue to increase at the commencement of the 20% speed cycle, but for the interaction of the faces 402 and 403 which limits axial advance and diametric expansion. The torque now stabilizes or begins to reduce. This condition is allowed to continue for about 7 seconds which, in the example, would be about 10 revolutions, to burnish a finished swage to the tube. This provides for accurate post-swage inspection. After this time period, the cycle for reversing and retracting the mandrel, and removal of the tube is according to swaging under torque control.

Burnishing under torque control could be effected by reducing torque for a preset time after a preset torque is reached and prior to the reversed procedure.

Computer System 9

With reference to FIG. 6, the above-described automatic swaging cycle can be provided by connecting the solenoid valves 60, 67, 108, 110, 152, 154, the motor 158, the torque transducer 168, and the interlock switch 78 in a computer system 9. The computer system 9 includes a micro computer 202, a motor speed control 203, an analog to digital converter 204 for the torque transducer 168 a clamp switch 205 a swage switch 206, a plurality of solenoid actuators 207 for the solenoid valves, a red indicator lamp 208, a green indicator lamp 209, a display unit 210, and a thumbwheel switch unit 211. Additionally, there is a pressure sensor switch 500 connected to input/output interface 218 for permitting periodic checking of the pressure in the systems for the mandrel, locking mechanism and tool advance system.

The micro computer 202 includes a micro processor 212, a program memory 214, a data memory 216, and the input-output interface 218. The micro computer 202 includes a program interrupt capability having associated clock circuitry for regularly interrupting one program sequence to perform another sequence.

The input-output interface 218, controlled by the micro processor 212 and the program memory 214, receives status signals from the pressure switch 500, interlock switch 78 and the swage switch 206, buffered by corresponding receivers 220, torque signals from the analog to digital converter 204, and parameter signals from the thumbwheel switch unit 211 which can be set for either torque control mode or diameter control mode. The input-output interface 218 also sends speed and direction signals to the motor speed control 203, information signals to the display unit 210 representing torque or diameter control information and, buffered by corresponding drivers 222, drive signals to the solenoid valves 108, (110, 152, 154, the red indicator lamp 208, and the green indicator lamp 209. The computer system 9 described herein is representative of several similar computer systems, any of which may be used to practice this invention. In a typical computer system, program steps and data are processed as eight-bit bytes, with program and data memory of up to 64,000 bytes being directly addressable.

The motor speed control 203, operating in combination with the micro computer 202, drives the motor 158 bidirectionally to predetermined speeds for rotating the tapered mandrel in an automatic swaging cycle according to the present invention. The micro computer 202 generates appropriate set points of motor speed and direction signals for accelerating and deccelerating the motor to the corresponding set points. The motor speed converter 230 receives the rate signals from the input-output interface of the micro computer 202. The digital to analog converter 230 drives a voltage controlled oscillator 232 over a corresponding frequency range. A reversible switch-tailed ring counter 234, having a plurality of stages corresponding to the windings of the motor 158, is driven by the voltage controlled oscillator 232 to produce signals appropriately shift in phase for driving the motor. Each stage of the ring counter 234 produces a pair of complementary counter signals, each signal connected through a drive amplifier 236 to a corresponding end of an associated winding of the motor 158. The direction signal produced by the micro computer 202, connected between the input-output interface 218 and the ring counter 234, determines the direction of counting of the ring counter 234 for controlling forward and reverse operation of the motor 158.

The motor 158 can have two windings phased at 90 degrees, as shown in the drawings. Correspondingly, the ring counter 232 has two stages connected to a total of four of the drive amplifiers 236. Four cycles of the voltage controlled oscellator are required to produce one cycle of magnetic rotation by the windings of the motor 158.

In an alternative version, not shown, the motor 158 has three windings phased at 60 degrees, the ring counter 234 has three states, and there are six of drive amplifiers 236. In this version, six cycles of the voltage controlled oscillator 232 are required to produce one cycle of magnetic rotation by the windings of the motor 158. This version, although more complex, advantageously makes use of a three-phase motor for greater motor availability and lower cost in appropriate power ratings than the two-phase version.

Preferably the voltage controlled oscillator 232 is prevented from oscillating when the rate signal corresponds to a set point of zero motor speed for conveniently stopping the motor. As the rate signal increases, the motor synchronously accelerates with the cycles of the ring counter 234 as it is driven by the voltage controlled oscillator 232.

The clamp switch 205, actuated by the operator, connects electrical power to the interlock switch 78 for operation of the first solenoid valve 60 and the auxiliary solenoid valve 67) by the corresponding solenoid actuator 207 to clamp the vise unit 2 closed. Unless the movable jaw 18 of the vise unit 2 is first closed, the interlock switch 78 prevents power from reaching the solenoid actuator 207. When the first solenoid valve 60 is operated, the power to the corresponding solenoid actuator 207 is sensed by the associated receiver 220 for input to the micro computer 202. Subsequent operation of the swage switch 206, sensed by the associated receiver 220 and input to the micro computer 202, can initiate the automatic swaging cycle.

The red indicator lamp 208 can be controlled by the micro computer 202 for indicating that a swaging cycle is in operation The green indicator lamp 209 can be controlled by the micro computer 202 for indicating that the vise unit 2 is clamped prior to, and following completion of a swaging cycle. When the green lamp 209 is on, the operater can properly initiate a swaging cycle or release the clamped condition of the vise unit 2. Preferably a new swaging cycle is inhibited until the vise unit 2 is first unclamped as described below.

With reference to FIGS. 7, 8 and 9, the computer system 9 can be programmed according to this invention to perform a sequence of steps, controlling the automatic swaging cycle in either the torque control mode or the diameter control mode. The sequence of steps comprises a program 300 for controlling the automatic swaging cycle, including the motor speed and direction set points, and for generating the varying rate and direction signals used by the motor speed control 203, and for sequencing the analog to digital connecter 204.

In the program 300, the system is started by pushing a swage button 301 to start the swaging operation. The pressure sensing switch 500 is first tested to determine whether the air pressure is adequate as indicated in step 302. Should the air pressure be inadequate, air pressure is applied as indicated by step 303. Eventually when the air pressure is adequate, the next test step is to determine whether the jaw in the vise unit 2 is closed. Should this not be the case, the next step 305 is to lock the jaw of vise unit 2 and ultimately when this has been achieved, the swaging cycle can be initiated. When the jaw is locked, the green indicator lamp 209 becomes illuminated, and the red indicator lamp 208 is extinguished.

Upon initiation of the swaging cycle, the motor 142 starts at a high forward RPM as indicated by step 305. The system then balances for zero torque indicated by step 306. With this information, the second solenoid valve 108 is activated and the tube expander feeds forwardly as indicated by step 307. There is a two second delay as indicated by step 308 and thereafter the solenoid valve 154 closes to feed the mandrel forwardly as indicated by step 309. At this point, the system tests whether the torque registered is greater than 25% of the set torque of the system as indicated by step 310. If not, the mandrel is fed forwardly until such time as the torque registered by the mandrel is greater than 25% of the said torque. At this point, the mandrel pneumatic feed 154 is switched off since a self-feed step can now be activated. The rollers of the mandrel at point when they register greater than 25% torque have made contact with the inside of the tubing to an extent that self-feeding will now continue to draw the mandrel inwardly into the tubing and effect the swage.

Interrogation step 312 continues whereby the torque is measured against the previous maximum value and this continues as indicated by step 313 until the set maximum torque value equals the current measured torque value. Should this not be the case, as indicated by branch 314, the routine followed is that indicated by step 315 which measures whether the previously-achieved torque is greater than 70 percent of the said torque. Should this not be the case, the torque measuring interrogation continues as indicated by step 316 and again in the interrogation step 317 determines whether the previously achieved torque is greater than 30% of the said torque. If not, the interrogation continues as indicated by step 318 to determine when this point is reached. If it is not reached, the motor speed is set to 100% full, as indicated by step 319 and this signal will flow along line 320.

Reverting back to steps 315 and 316, if the torque reaches 70% of the said torque, the branch sequence 321 checks by step 322 to ensure that the set torque is greater to or equal than 10 in-lbs. Should this be the case, the speed is set to 20% of full speed as indicated by step 323 and a signal then passes along line 324. Contrarily, should the set torque not be greater or equal to 10 in-lbs., then the step 325 sets the motor speed at about 60% of full speed and the signal passes along line 326.

Similarly, in the branch sequence 327, the testing is to determine whether the torque is greater than 30% of the set torque and should this be the case, the motor speed is set to be inversely proportional to the maximum torque reached as indicated by step 328 and the signal passes along line 329.

Accordingly, along line 330, there can be any one of the signals from line 326, being 60% full speed, line 324 being 20% of full speed, line 329 being the inverse motor speed, or line 320 being the 100% full speed of the motor.

The next state of the process is to inquire as indicated in step 331 whether the swaging is to be controlled in the fixed diameter mode or, alternatively, in the control torque mode. Should this be in the fixed diameter mode, branch 332 indicates that the first inquiry 333 is to determine whether the measured torque is greater or equal to the previous maximum torque value. Should this be the case, as indicated by line 334, the inquiry then is to determine whether the current torque is greater than 130 in-lbs. as indicated by step 335. This would be an overload condition generally if a machine is set for about 100 in-lbs. maximum. With an overload signal along line 336 the horn would be turned on as indicated by step 337 and the stop reverse sequence is followed. Should this not be the case, then the system cycles back to the torque inquiry step 312 as indicated by line 338. Ultimately, after proceeding through the various steps from 315 to generate a signal on 330, the system will generate to a position where the reverse sequence 336 is followed as if overload conditions exist.

Returning to step 333, when the measured torque is not greater nor equal to the previous maximum torque, then the procedure is one where increased torque ends and torque begins to reduce as the burnishing step is engaged. Step 334 then measures whether seven seconds have elapsed since the decrease first noted in step 333. Such decrease is compatible with the diameter mode positive stop interaction which causes the decrease in torque. After the seven second elapse during which burnishing occurs, the sequence follows line 335 and line 338 to the reversal procedures along line 339.

In the torque control mode, after the inquiry through step 331, the sequence follows to step 340 where the inquiry determines whether 100% of set torque has been reached. If yes, as indicated by line 341, the sequence follows along 339 to reach the reverse.

In the reversing sequence, the first step is for the motor 142 to reverse at high speed as indicated by step 342. After a five second delay, as indicated by step 343, the mandrel moves backward, according to step 344, and after a further four second delay, according to step 345, the tube expander moves backwards according to step 346. A two second delay follows according to step 347 whereafter the motor is stopped and the air cylinders are neutralized as indicated by step 348 ending finally with the end step 349.

As indicated in FIG. 8, the valve timing cycles, v2, v3, v4 and v5 indicate how the respective solenoids 108, 110, 152 and 154 operate in the ON and OFF states. These ON and OFF states relate to the computer flow chart sequence. Thus, v2 and v5 act in the forward going sequence and v3 and v4 are active and on in the reverse going sequence.

Also, as indicated in FIG. 8, there is the timing sequence of speed and torque for the torque control mode of swaging. In this diagram, line 350 indicates 100% speed. Line 351 represents the ramping down of the speed to 20% as indicated by line 352. Line 353 indicates the switching of the motor into the reversing speed, as indicated by line 354 until final switch-off at point 355. The ramp line 351 is representative of pulse-modulated speed control wherein there is increased dwell-time at high speed and lower dwell-time at zero speed. This progressively switches such when the time 352 is reached, namely, 20% speed, the dwell-time is greater at the zero speed than at the high speed. This overall has an effect of reducing motor speed. The point 355, indicating where the ramp reduction of speed commences, is equivalent to the approximate value of 30% full torque, which 30% point is indicated at point 357. The full torque point is at 358 on the torque curve. At point 359, the torque level is approximately 70 percent which corresponds to the 20% motor speed After the speed reversal is set in motion, the torque drops off to zero, as indicated by line 360, and then in the reverse mode, there is torque readings or negative torques are indicated generally by lines 361.

In the diameter control mode, as illustrated in FIG. 9, the speed curve is similar to the speed control for the torque mode and the points indicated on the speed curve are the same as referred to with regard to FIG. 8. What is different, however, is part of the torque curve. Whereas the ramp decrease is initiated at point 362 of the torque curve, the maximum torque a point 363 is substantially where the 20% speed of the motor is in effect. There then follows a decrease in torque as indicated by line 364 during the burnishing phase while the motor maintains the 20% speed as indicated by line 352. During reversal, the torque falls off similarly to the indication in FIG. 8, namely, at point 360. A variable negative torque situation is indicated generally by line 361. Thus, during the burnishing seven second time period, there is less torque being applied to the tubing and the speed is low. This provides for accurate completion of the swage.

Although the present invention has been described in detail with regard to different embodiments, other embodiments are possible. For instance, although burnishing has been described only with regard to the diameter control mode, it is possible to effect burnishing also in the torque control mode. The overall swage cycle time from beginning the sequence to the end is contained in less than one minute and, preferably, about 45 seconds. This is an effective efficient cycle time while at the same time optimizing the effects of the swaging tool, relative to speed and torque action on the tubing so that a highly desirable and product can be effectively obtained. The additional feature of providing for either torque control swaging or diameter control swaging provides a system which is highly desirable so that tube swaging can be effected under either control condition dependent on the tube coupling material or configuration being swaged. Clearly, the machine and particularly its actuation can operate effectively under pneumatic or hydraulic pressure system or alternatively stepper motors, electrical solenoids and the like operatively arranged to activate the system.

The invention is not limited by the described embodiments, but solely by the claims.

What is claimed is:

1. A roller swaging machine for installing a metallic sleeve on a metallic tube by expanding the tube into engagement with the sleeve, the machine comprising:

(a) an expander assembly having a tapered mandrel for engaging a plurality of tapered rollers for expanding the tube as the mandrel is rotated and advanced on its axis, the mandrel requiring a final maximum torque as the tube reaches complete expansion;

(b) a drive for rotating the mandrel in a swaging cycle, the drive being capable of rotating the mandrel at high speed and at low speeds; and (c) control means for the drive for (i) rotating the mandrel at the high speed during initial expansion of the tube when rotation of the mandrel requires less than a predetermined ramp threshold torque of less than 50 percent of the final maximum torque;

(ii) following the initial expansion of the tube and when rotation of the mandrel requires less than a predetermined intermediate torque of less than the final maximum torque but at least 60 percent thereof, continuously reducing the speed of the mandrel to a low speed, the low speed being between about 10 and 30 percent of the high speed; and (iii) during final expansion of the tube when rotation of the mandrel requires more than the intermediate torque, rotating the mandrel at the low speed.

2. The machine as claimed in claim 1 wherein the intermediate torque is about 70 percent of final maximum torque.

3. The machine as claimed in claim 2 wherein the low speed is about 20 percent of the high speed.

4. The machine of claim 3 wherein the swaging cycle includes means for automatically inserting the expander assembly into the tube, advancing the mandrel into engagement with the rollers and, following the final expansion of the tube, reversing rotation of the mandrel for releasing the expander assembly, and retracting the mandrel and the expander assembly from the tube,

5. The machine of claim 1 wherein the ramp threshold torque level is about 30 percent of the final torque level.

6. The machine of either claim 1, 2 or 5 including means for sensing the torque required to rotate the mandrel during swaging, wherein swaging is terminated at a predetermined final torque level.

7. The machine of claim 6 wherein the means for sensing the torque comprises means for measuring an initial torque level required to rotate the mandrel before the tube begins to expand and means for compensating measured torque levels during swaging by an amount corresponding to the initial torque level.

8. The machine of claim 7 wherein the initial torque level is measured in each swaging cycle.

9. A method for installing a metallic fitting on a metallic tube by roller-swaging where a tapered mandrel is rotated and fed into the tube to expand the tube into engagement with the fitting, wherein the mandrel requires a final torque as the tube reaches complete expansion, comprising the steps of:

(a) during a first period of time, during which time the torque on the mandrel reaches a ramp threshold torque of less than 50 percent of the final torque, rotating the mandrel at a first high speed for rapidly expanding the tube into engagement with the fitting;

(b) during a second period of time in which the torque increases from the ramp threshold torque to an intermediate torque of at least 60 percent of the final torque, reducing the speed of the mandrel to a lower second speed of between about 10 and 30 percent of the first speed, the second speed not being exceeded once the mandrel requires at least 90 percent of the final torque; and (c) rotating the mandrel at the second speed until swaging is complete.

10. The method as claimed in claim 9 wherein the ramp threshold torque is about 30 percent of the maximum torque, and the intermediate torque is about 70 percent of the maximum torque.

11. The method as claimed in claim 10 wherein the low speed is about 20 percent of the high speed.

12. The method as claimed in claim 9 including limiting expansion of the tube at a predetermined diameter expansion after the commencement of the second speed of the mandrel.

13. The method as claimed in claim 12 wherein the low speed is about 20 percent of the high speed.

14. A method for installing a metallic fitting on a metallic tube by roller-swaging a tapered mandrel is rotated and fed into the tube to expand the tube into engagement with the fitting, the rotation continuing until the torque on the mandrel reaches a final preselected value, comprising the steps of:

(a) during a first period of time, during which time the torque on the mandrel reaches a ramp threshold value of less than about 50 percent of the final preselected value, rotating the mandrel at a first high speed for rapidly expanding the tube into engagement with the fitting;

(b) during a second period of time in which the torque increases form the ramp threshold torque to an intermediate torque of at least 60 percent of the final preselected value, reducing the speed of the mandrel to a lower second speed, the lower second speed being between about 10 and 30 percent of the first speed, the second not being exceeded once the torque on the mandrel reaches 70 percent of the first preselected value; and (c) rotating the mandrel at the second speed until the torque reaches the final preselected value.

15. The method of claim 14 wherein the ramp threshold torque is about 30 percent of the final preselected value.

16. The method of claim 15 wherein the speed is ramped downwardly during the second period of time, and the intermediate torque is about 70 percent of the final preselected value.

17. A roller swaging machine for installing a metallic sleeve on a metallic tube by expanding the tube into engagement with the sleeve, the machine comprising:

(a) an expander assembly having a tapered mandrel for engaging a plurality of tapered rollers for expanding the tube as the mandrel is rotated and advanced on its axis;

(b) a drive for rotating the mandrel in a swaging cycle, the drive being capable of rotating the mandrel at a high speed and at low speeds; and (c) control means for the drive for (i) rotating the mandrel at the high speed during initial expansion of the tube;

(ii) during further expansion of the tube, when rotation of the mandrel requires more than a ramp threshold level of less than about 50 percent of a preset maximum torque value, ramping the mandrel speed downwardly to a low speed of between about 10 to 30 percent of the high speed, the low speed being reached when the torque is at least about 70 percent of the final maximum torque value; and (iii) continuing at the low speed until swaging is complete.

18. The machine as claimed in claim 17 including mechanical means to limit expansion of the expander assembly at a predetermined diameter expansion.

19. The machine as claimed in claim 18 wherein the mechanical means limits expansion after the onset of the low speed.

20. The machine as claimed in claim 17 or 18 wherein the low speed is about 20 percent of the high speed.

21. The machine of claim 15 wherein the means for sensing the torque comprises means for measuring an initial torque level required to rotate the mandrel before the tube begins to expand and means for compensating measured torque levels during swaging by an amount corresponding to the initial torque level.

22. The machine of either claim 17, 18, or 19 wherein the ramp threshold level is about 30 percent of the maximum torque value.

23. The machine of claim 22 wherein the swaging cycle includes means for automatically inserting the expander assembly into the tube, advancing the mandrel into engagement with the rollers and, following the final expansion of the tube, reversing rotation of the mandrel for releasing the expander assembly, and retracting the mandrel and the expander assembly from the tube.

24. A method for installing a metallic fitting on a metallic tube by roller-swaging where a tapered mandrel is rotated and fed into the tube to expand the tube into engagement with the fitting the rotation expansion continuing until the diameter of the mandrel reaches a final preselected value, comprising the steps of:

(a) during a first period of time, during which time the torque on the mandrel reaches about 30 percent of the final torque, rotating the mandrel at a first high speed for rapidly expanding the tube into engagement with the fitting;

(b) during a second period of time, ramp reducing the speed of the mandrel to a lower speed, the lower second speed being about 20 percent of the first speed, the second speed not being reached until the torque on the mandrel reaches at least about 70 percent of the final value, and not being exceeded once the torque on the mandrel reaches at least 90 percent of the final value;

(c) rotating the mandrel at the second speed until the diameter of the mandrel reaches the preselected value; and (d) continuing the rotation at the second speed for a preselected time to effect tube burnishing, the torque being reduced from the final value.

25. A roller swaging machine for installing a metallic sleeve on metallic tube by expanding the tube into engagement with the sleeve, the machine comprising:

(a) an expander assembly having a tapered mandrel for engaging a plurality of tapered rollers for expanding the tube as the mandrel is rotated and advanced on its axis;

(b) a drive for rotating the mandrel in a swaging cycle, the drive being capable of rotating the mandrel at a high speed and at low speeds; and (c) control means for the drive for (i) rotating the mandrel at the high speed during initial expansion of the tube;

(ii) during further expansion of the tube, when rotation of the mandrel requires more than about 30 percent of the final maximum torque, ramping the mandrel speed downwardly to a low speed between about 10 to 30 percent of the high speed; and (iii) selectively either reaching the limit of expansion under diameter control of the expander whereby maximum expansion is achieved after commencement of the low speed, or controlling the swage under torque control, whereby maximum expansion is achieved at about the end of the low speed cycle, the expansion increasing to a final value during the low speed operation.

26. A machine as claimed in claim 25 wherein diameter control expansion of the mandrel is effected by sensing changes in torque on the mandrel.

27. The machine as claimed in claim 25 including mechanical means to limit expansion of the expander assembly at a predetermined diameter expansion.

28. A machine as claimed in claim 27 wherein the mechanical stop is mounted on an extension of the mandrel and is movable with the mandrel, such that an interaction between the mechanical stop and a housing for the mandrel in an axial sense regulates further movement of the mandrel and the diameter expansion of the rollers.

29. The machine as claimed in claim 25 wherein the low speed about 20% of the high speed.

30. A swaging machine as claimed in claim 25 wherein the swaging cycle is less than about one minute.

31. The machine as claimed in claim 25 wherein burnishing of the swaged tube is effected after swaging.

32. A machine as claimed in claim 31 wherein burnishing is effected in a preset time for a preset number of revolutions of the tube relative to the mandrel and at the low speed.

33. The machine of either claim 1, 17 or 25 wherein ramp reduction of the speed of the mandrel is effected by controlling the speed as a function of the torque required for turning the mandrel.

34. The machine of claim 33 the function comprises the reciprocal of the required torque.

35. A method for installing a metallic fitting on a metallic tube by roller-swaging where a tapered mandrel is rotated and fit into the tube to expand the tube into engaging with the fitting, comprising the steps of:

(a) during a first period of time, during which the torque required for rotating the mandrel reaches about 30 percent of the final torque, rotating the mandrel at a high first speed for rapidly expanding the tube into engagement with the fitting;

(b) during a second period of time ramp reducing the speed of the mandrel to a lower second speed, the second speed being between about 10 to 30 percent of the first speed, the second speed being reached after the torque required for rotating the mandrel reaches at least about 70 percent of the final torque; and (c) selectively either increasing the torque at the commencement at the second speed and concluding swaging when a maximum torque is reached whereby controlling the swage by torque control, or reaching about maximum torque at the beginning of the second speed period whereafter expansion is limited and the torque no longer increases such that the tube expansion is effected by diameter control of mandrel expansion.

36. The method as claimed in claim 35 wherein burnishing is effected to the inside of the tube after expansion completion of expansion.

37. The method as claimed in claim 35 wherein the low speed is about 20 percent of the high speed.

38. The method of either claim 9, 14, 24, or 35 wherein the step of reducing the speed of the mandrel comprises the step of controlling the speed as an inverse function of the torque required to rotate the mandrel.

* * * * *